United States Patent [19]

Richart et al.

[11] Patent Number: 4,523,878

[45] Date of Patent: Jun. 18, 1985

[54] REMOTELY REPLACEABLE GUIDEPOST METHOD AND APPARATUS

[75] Inventors: Jene A. Richart, Houston, Tex.; Bradley D. Beitler, Ojai, Calif.; David G. Deeken, Weybridge, England

[73] Assignee: Exxon Production Research Co., Houston, Tex.

[21] Appl. No.: 599,884

[22] Filed: Apr. 13, 1984

Related U.S. Application Data

[63] Continuation of Ser. No. 296,762, Aug. 27, 1981, abandoned.

[51] Int. Cl.[3] ..... E02D 29/00; E21B 7/128; E21B 43/013; E16L 1/04

[52] U.S. Cl. ..... 405/195; 405/169; 166/340; 175/7

[58] Field of Search ..... 405/168, 169, 195, 188; 166/301, 339, 340, 342; 175/7; 294/90; 403/2

[56] References Cited

U.S. PATENT DOCUMENTS

| | | | |
|---|---|---|---|
| 3,050,139 | 8/1962 | Hayes . | |
| 3,050,140 | 8/1962 | Hayes . | |
| 3,114,420 | 12/1963 | Wilde . | |
| 3,163,228 | 12/1964 | Hayes | 166/349 X |
| 3,172,693 | 3/1965 | Hansen | 294/90 |
| 3,236,302 | 2/1966 | Postlewaite . | |
| 3,500,905 | 3/1970 | Petersen . | |
| 3,545,539 | 12/1970 | Manning . | |
| 3,841,665 | 10/1974 | Capot | 166/340 X |
| 4,017,196 | 4/1977 | Pean et al. | 403/2 |
| 4,095,649 | 6/1978 | Chateau et al. | 175/7 X |
| 4,347,012 | 8/1982 | Glidden | 403/2 |
| 4,439,068 | 3/1984 | Pokladnik . | |

*Primary Examiner*—Thomas F. Callaghan
*Assistant Examiner*—Nancy J. Stodola
*Attorney, Agent, or Firm*—Keith A. Bell

[57] ABSTRACT

A method and apparatus for remotely replacing damaged guideposts attached to a subsea structure are provided. A receptacle is permanently attached to the subsea structure. The guidepost is inserted into the receptacle and is releasably connected thereto by one or more radially-oriented, spring loaded lock pins. Damaged guideposts are removed by applying an upward vertical force to the guidepost sufficient to shear the lock pin or lock pins. The upward vertical force is applied by a replacement tool capable of being remotely operated from the surface of the body of water. Following removal of the damaged guidepost, a new guidepost is inserted into the receptacle. Lock pins mounted in the new guidepost retract into the guidepost as it is being inserted. When fully inserted, the lock pins extend and engage a retaining groove formed in the receptacle thereby firmly locking the new guidepost in place.

12 Claims, 7 Drawing Figures

60
66
88
74
104
68
62
72
70
18
64
62
72
74
80
68
6
6
96
66
88
84
98
102
100

104
60
74
62
90
102
78
100
5
5
72
84
96
80
90
76
88
82
68
98
70
92
62
94
64
86

REMOTELY REPLACEABLE GUIDEPOST METHOD AND APPARATUS

This application is a continuation, of application Ser. No. 296,762, filed Aug. 27, 1981 now abandoned.

BACKGROUND OF THE INVENTION

This invention relates to a guidepost system used to aid in aligning an object lowered from the ocean surface to a predetermined location on a subsea structure. More particularly, the invention pertains to a method and apparatus for remotely replacing damaged guideposts attached to subsea structures.

The exploitation of offshore oil fields frequently involves the construction of fixed subsea facilities for use in conducting drilling, completion and production operations. Fixed subsea facilities are especially useful in oil fields located in deep water where conducting such operations from fixed or floating surface structures would be either prohibitively expensive or technically unfeasible. The installation, operation and maintenance of subsea facilities requires that various types of equipment be lowered from the surface of the body of water to a precise location on the subsea structure. In order to accomplish this, means must be provided for properly aligning the lowered equipment with the target area on the structure.

The most widely employed method of accomplishing this alignment is by the use of guidelines. In a typical guideline system a base is mounted on the subsea structure at the target location. One or more upright guideposts are attached to the base. A tensioned wire rope guideline is connected to the top of each guidepost and extends upwardly to the surface of the body of water. The equipment being lowered is attached to a guide frame which is lowered down the guidelines until it engages the guideposts. In this manner the equipment is directed to the desired position on the subsea structure. See, for example, the guideline system disclosed in U.S. Pat. No. 3,050,139 issued to Hayes (1962).

Guideposts may also be used to accomplish the necessary alignment without attached guidelines. See, for example, the alignment system described in U.S. Pat. No. 3,545,539 issued to Manning (1970).

Guideposts attached to subsea structures are subject to damage which oftentimes necessitates replacement. Damage to the guideposts may occur in several ways. For example, undersea currents can cause heavy equipment being lowered to the subsea structure to shift, thereby striking and bending the guideposts. Alternatively, the equipment being lowered may shift or drop suddenly due to wave induced movement of the surface vessel or structure. This sudden movement may damage or destroy the guideposts.

At best, replacement of a damaged guidepost is extremely difficult. Typically, guideposts are either welded or bolted to the subsea structure. If the subsea structure is located in shallow water, divers may be used to remove the damaged guidepost and install an undamaged one in its place. If, however, the subsea structure is located in deep water, a mini-submarine or other manned submersible vessel must be used to make the replacement. Thus, there is a need for a guidepost system which permits damaged guideposts to be removed and replaced with undamaged ones from a remote location, such as the surface of the body of water.

SUMMARY OF THE INVENTION

The present invention deals with the problem of replacing damaged guideposts by providing a guidepost which may be removed and replaced from a remote location.

A receptacle designed to retain the guidepost in position is permanently attached to the subsea structure. The receptacle has a tapered upper portion so as to eliminate binding between the guidepost and the receptacle when the guidepost is removed. The guidepost itself has a tapered section, at least one radially oriented, spring loaded lock pin, and a support shoulder which contacts the top of the receptacle and transmits downward vertical loads to the subsea structure. The lock pin engages a retaining groove formed in the receptacle immediately below the tapered upper portion thereby firmly locking the guidepost in place. Additionally, the guidepost design includes a weak section, obtained by a change in section modulus, so that if the post is damaged the damage will occur at or above the weak section and the bottom section will remain vertical facilitating removal of the guidepost.

Damaged guideposts are removed by applying an upward vertical force to the guidepost sufficient to shear the lock pin or lock pins. This upward vertical force is applied to the guidepost by a remotely operable guidepost replacement tool, described below. After the damaged guidepost has been removed, an undamaged guidepost is inserted into the receptacle in place of the damaged post. As the new post is being inserted, the lock pin or lock pins contact the sloped upper portion of the receptacle. This forces the lock pin or lock pins to retract into the guidepost. When the post is fully inserted into the receptacle, the lock pin or lock pins extend to engage the retaining groove thereby locking the new post firmly in place.

The remotely operable guidepost replacement tool may be any tool which is capable of gripping the guidepost and applying an upward vertical force thereto. In a preferred embodiment, the replacement tool comprises a horseshoe shaped body having three gripper blocks. One of these gripper blocks is stationary and the other two slide in slots cut at an angle to the horseshoe body's centerline. Hydraulic cylinders formed in the body of the replacement tool are used to move the movable gripper blocks. When the hydraulic cylinders are retracted, the gripper blocks move in the slots toward the center of the horseshoe. When the post is in the horseshoe and the cylinders are retracted, the post is locked firmly into the horseshoe body by three point contact with the gripper blocks. Upward force may then be applied to the replacement tool to shear the post lock pins. This force would typically be transmitted directly from the surface vessel or structure to the replacement tool. Alternatively, the tool may be mounted on a subsea handling frame capable of applying the upward vertical force directly to the replacement tool.

When practicing the method of the present invention it may be necessary to use a television monitoring system to aid in proper positioning of the replacement tool. Such assistance may also be necessary in properly inserting the replacement post into the receptacle.

DETAILED DESCRIPTION OF THE PREFERRED EMBODIMENT

Figure 1:
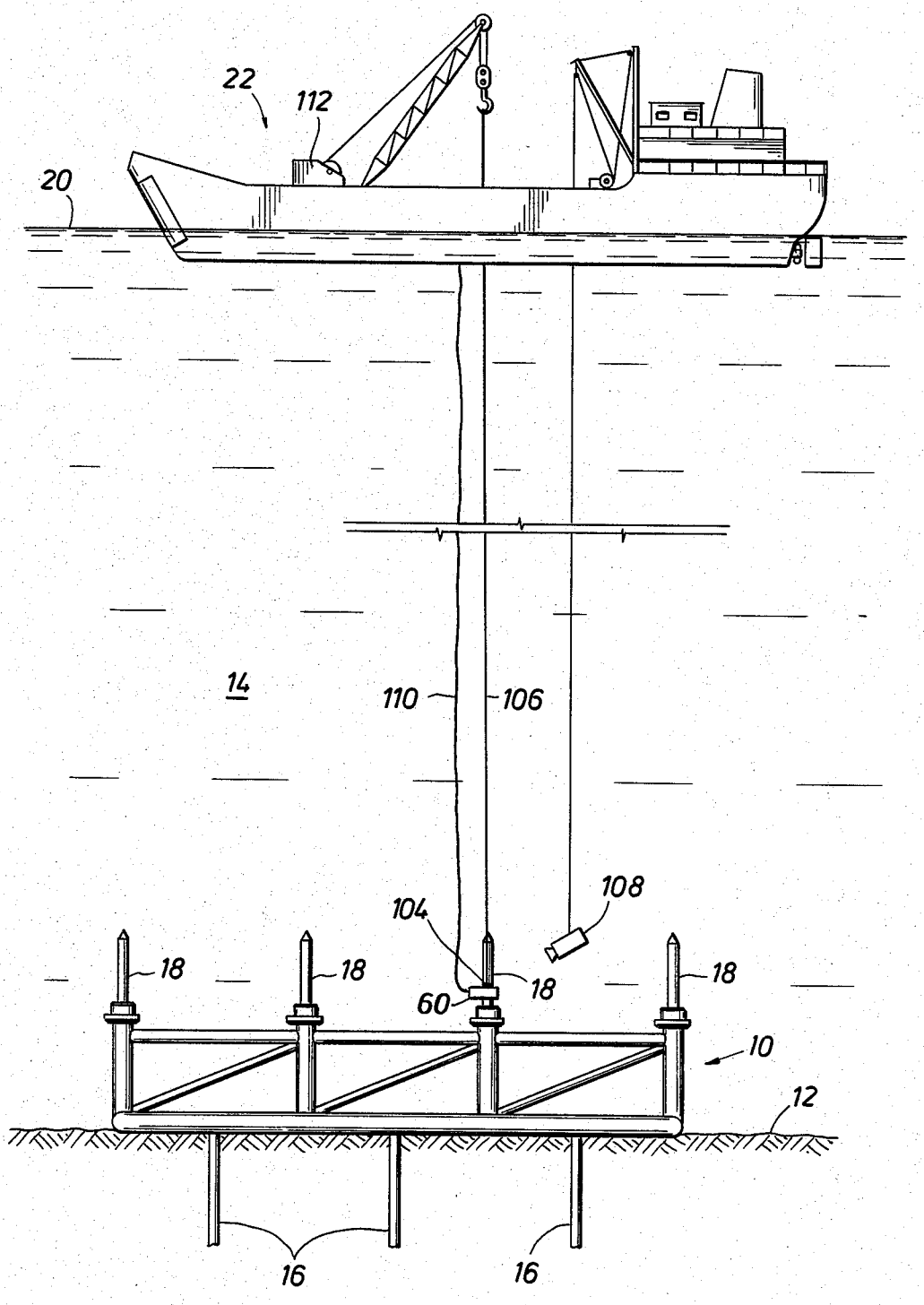
FIG. 1 illustrates in side elevation the remotely replaceable guidepost system of the present invention.

FIG. 1 depicts the remotely replaceable guidepost system of the present invention. A subsea production facility 10 located on the bottom 12 of body of water 14 is used to produce oil or gas from wells 16. A plurality of vertical guideposts 18 are located on the top surface of subsea production facility 10. The guideposts 18 are used to aid in the alignment of equipment lowered from the surface 20 of body of water 14 to subsea production facility 10. Typically, the equipment would be lowered by drill ship 22. Alternatively, a floating surface structure, well known in the applicable art, could be used to lower the equipment.

Guideposts 18 are subject to damage from a variety of causes. For example, massive equipment being lowered to subsea production facility 10 may shift or drop due to wave or current induced movement of drill ship 22, thereby striking the guideposts with sufficient force to cause damage. Damaged guideposts must be replaced before further equipment can be lowered to the facility and properly aligned.

In typical guidepost systems of the prior art, guideposts are permanently attached to the subsea facility. Thus, replacement of damaged guideposts is, at best, extremely difficult. In shallow water locations divers may be used to perform this task. In water depths too deep for divers, a mini-submarine or other manned submersible vessel must be used to accomplish the replacement. The present invention provides a method and apparatus whereby damaged guideposts may be replaced from a remote location, such as the surface of the body of water.

Figure 2:
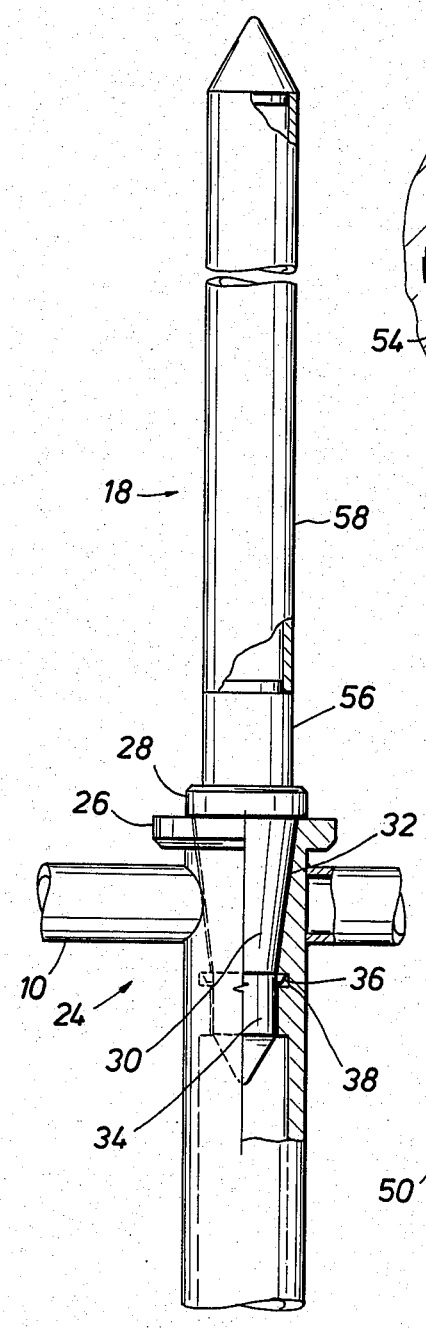
FIG. 2 is a side elevation in partial cross section showing the guidepost and the receptacle.

FIG. 2 illustrates the remotely replaceable guidepost system of the present invention. The guidepost 18 is inserted into receptacle 24 which is permanently attached to subsea production facility 10. Preferably, receptacle 24 is formed within one of the structural members of subsea production facility 10. In this manner, loads applied to guidepost 18 are transmitted directly to subsea production facility 10. A flange 26 is located at the top of receptacle 24. Guidepost 18 includes support shoulder 28 which contacts flange 26. Downward vertical loads applied to guidepost 18 are transmitted by support shoulder 28 to flange 26 and thereby to subsea production facility 10.

In order to prevent binding when the post is inserted or removed, guidepost 18 and receptacle 24 have matched tapered sections. The tapered section 30 of guidepost 18 is located immediately below support shoulder 28. Typically, tapered section 30 would be circular in cross section, however, any cross section may be used if necessary or desired. For example, if specific angular alignment of guidepost 18 is necessary, a square cross section may be used. The tapered portion 32 of receptacle 24 is located immediately below flange 26 and must be such that it will properly mate with tapered section 30 of guidepost 18. The amount of taper necessary in order to prevent binding is not large. Typically, a taper of between 5° and 10° from the vertical will be sufficient. However, a larger or smaller taper may be used if desired.

Below tapered section 30 of guidepost 18 is pilot section 34. Pilot section 34 is untapered and, typically, would be of circular cross section. At least one radially oriented, spring loaded lock pin 36, described below, is mounted in pilot section 34. Typically, a plurality of lock pins would be used.

Receptacle 24 further comprises a retaining groove 38 formed below tapered portion 32. The purpose of retaining groove 38 is to engage the lock pin or lock pins thereby locking guidepost 18 firmly in place.

Figure 3:
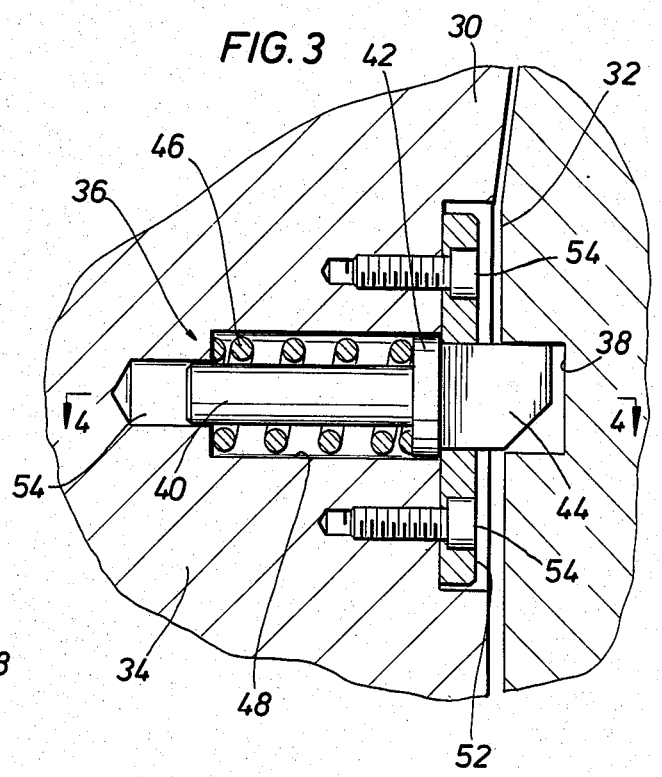
FIG. 3 is a cross-sectional side view of a typical lock pin assembly for use in connection with the present invention.
Figure 4:
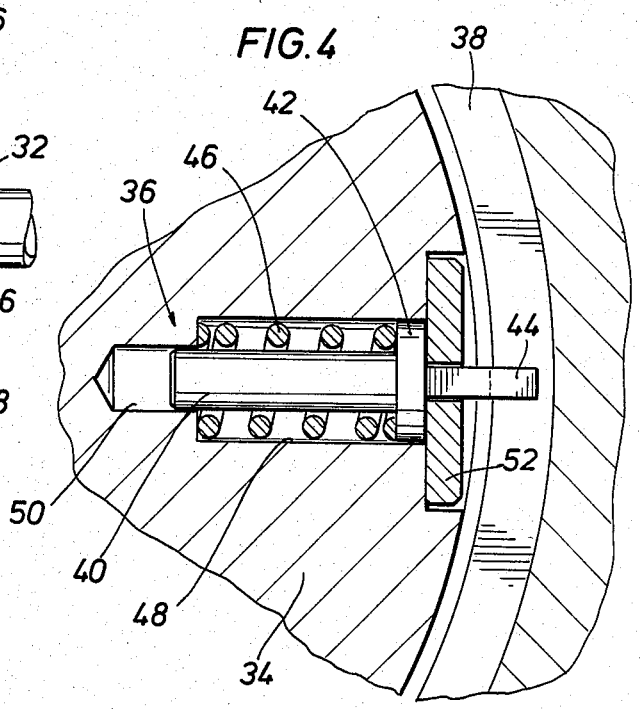
FIG. 4 is a cross-sectional top view of the lock pin assembly taken along line 4—4 of FIG. 3.

FIGS. 3 and 4 illustrate a typical lock pin assembly. The lock pin 36 has a shaft 40, a shoulder 42, and a locking head 44. Shaft 40 and shoulder 42 would typically have circular cross sections. Locking head 44 may have any cross section calculated to provide the desired resistance to shear. Lock pin 36 is mounted in pilot section 34 of guidepost 18. The lock pin is oriented so that its longitudinal centerline coincides with a transverse radial line of pilot section 34. More than one lock pin 36 may be used in which case the several lock pins would be equally spaced about the circumference of pilot section 34. A compression spring 46 surrounds shaft 40. Lock pin 36 and compression spring 46 are inserted into cavity 48 formed in pilot section 34. The diameter of cavity 48 is slightly larger than the outside diameter of compression spring 46 when it is fully compressed. Shoulder 42 of lock pin 36 must be sized so that it will slide freely in cavity 48. The diameter of shaft 40 should be slightly less than the inside diameter of compression spring 46 when it is fully extended. The inner end of shaft 40 extends into pilot bore 50 which should be sized so as to allow shaft 40 to slide freely. The depth of pilot bore 50 should be sufficient to allow lock pin 36 to retract fully into pilot section 34. Lock pin 36 and compression spring 46 are held in place by retaining plate 52 which is fastened to the outside of pilot section 34 by a plurality of screws 54. Other fastening means, well known to those skilled in the art, may also be used. Locking head 44 of lock pin 36 extends through a slot in retaining plate 52 to engage retaining groove 38. The slot in retaining plate 52 vertically orients locking head 44 of lock pin 36 and prevents rotation of the lock pin. Shoulder 42 of lock pin 36 is forced against retaining plate 52 by compression spring 46.

During insertion of guidepost 18 into receptacle 24, lock pin 36 comes into contact with tapered portion 32 of receptacle 24. The weight of the guidepost forces lock pin 36 to retract into cavity 48. When the guidepost 18 is fully inserted into receptacle 24 lock pin 36 is aligned with retaining groove 38. Compression spring 46 then causes lock pin 36 to extend and engage retaining groove 38, thereby locking the post in place. Damaged posts are removed by applying an upward vertical force to the post sufficient to shear the lock pins. The sheared portion of the lock pins is simply allowed to fall to the bottom of receptacle 24. Preferably, receptacle 24 is open at its bottom end.

An additional feature of guidepost 18 is its ability to direct the location of damage to the guidepost. As shown in FIG. 2, the portion of guidepost 18 which is above support shoulder 28 has two distinct sections. The lower section 56 is solid while the upper section 58 is tubular. Typically, both lower section 56 and upper section 58 would be circular in cross section, however, other cross sections may be used if desired. The section modulus of upper section 58 is smaller than the section modulus of lower section 56. Therefore, upper section 58 has less resistance to bending than does lower section 56. Due to this change in section modulus, damage due to misalignment of equipment being lowered to the subsea facility normally will occur at or above the junction between lower section 56 and upper section 58. Thus, lower section 56 will remain vertical, thereby facilitating removal of the post.

Figure 5:
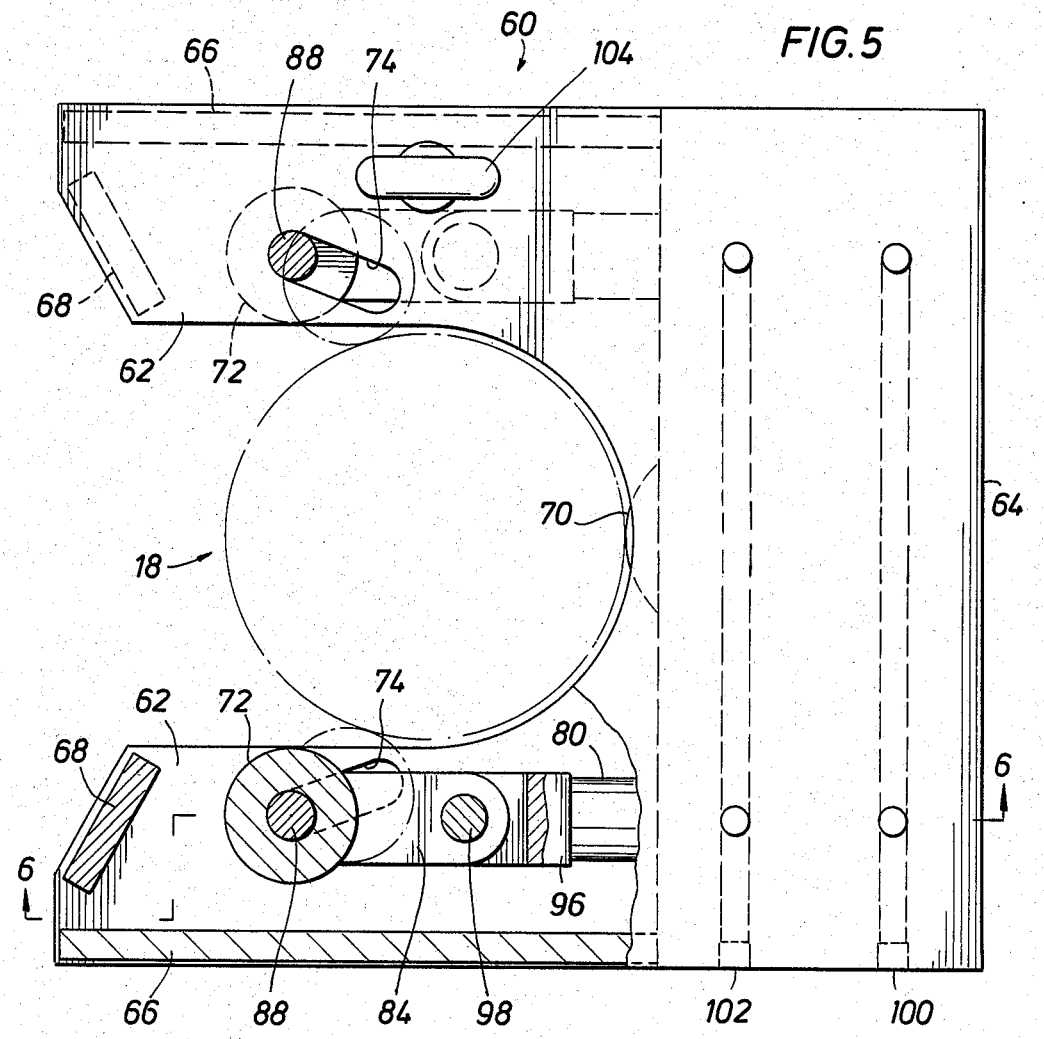
FIG. 5 is a top view in partial cross section of a typical replacement tool for use in connection with the present invention taken along line 5—5 of FIG. 6.
Figure 6:
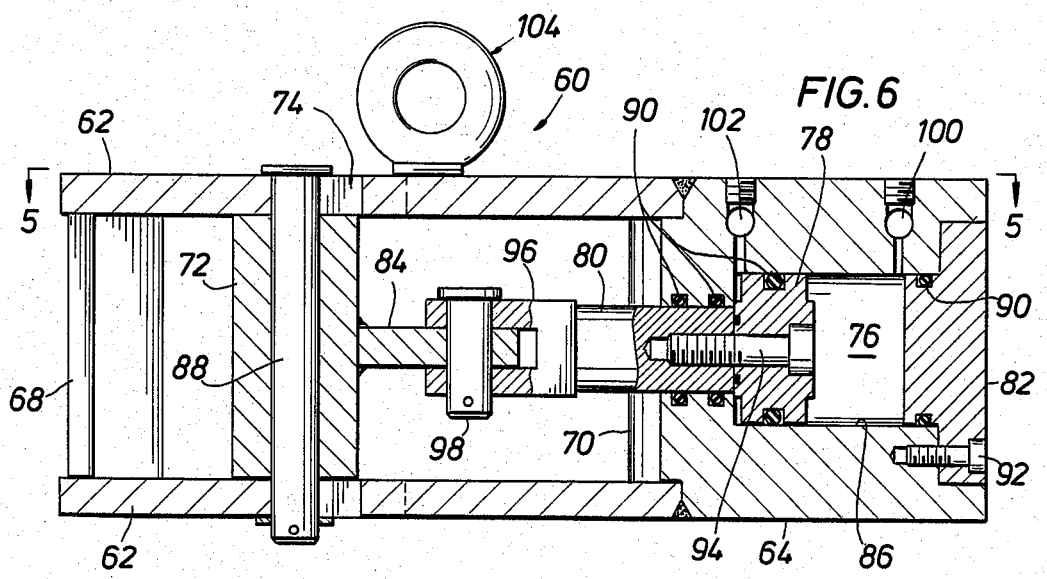
FIG. 6 is a cross-sectional side view of the replacement tool taken along line 6—6 of FIG. 5.

As stated above, damaged guideposts are removed by applying an upward vertical force to the guidepost sufficient to shear the lock pin or lock pins. This force is applied with the aid of a remotely operable guidepost replacement tool. One such remotely operable guidepost replacement tool for use with a circular guidepost is illustrated in FIGS. 5 and 6. Other suitable tools will be readily apparent to those skilled in the art. Referring now to FIGS. 5 and 6, the body of replacement tool 60 consists of two horseshoe-shaped plates 62 permanently attached to end block 64. Additionally, two side plates 66 and two spacer blocks 68 are used to strengthen and support horseshoe-shaped plates 62 and to maintain the proper spacing therebetween. The U-shaped opening in horseshoe-shaped plates 62 must be slightly larger than the outside diameter of the guidepost 18 so that the replacement tool can be easily fitted over the guidepost. For example, for a guidepost having an outside diameter of 9⅝ inches, the U-shaped opening should be approximately 10 inches wide. Eyes 104 (see FIG. 6) are mounted on the upper horseshoe-shaped plate 62 on each side of the U-shaped opening to facilitate connection of the replacement tool to the surface vessel. The eyes should be located on a diametral line through the center of the post so that the force applied to the post is axial. A fixed gripper block 70 is located at the bottom of the U-shaped opening on the longitudinal centerline of the replacement tool. The fixed gripper block 70 is fixedly attached to end block 64. Due to potential wear of the gripping surface, fixed gripper block 70 should be attached to end block 64 in a manner which will allow easy replacement. Two movable gripper blocks 72 are located in the arms of the replacement tool. These movable gripper blocks 72 are mounted on shafts 88 and slide in slots 74 which are cut at an angle to the replacement tool's longitudinal centerline. A link arm 84 is fixed to each movable gripper block 72. Two hydraulic cylinders 76 are formed in end block 64. Each cylinder is attached to one of the movable gripper blocks 72. Each cylinder consists of piston 78, piston rod 80, and end cap 82. Piston 78 moves in bore 86. A plurality of O-rings 90 of various sizes are used to prevent leakage of the hydraulic fluid. End cap 82 is attached to end block 64 by a plurality of screws 92. Piston rod 80 is attached to piston 78 by screw 94. A clevis 96 is mounted to the forward end of piston rod 80. Link arm 84 is rotatably attached to clevis 96 by clevis pin 98. Thus, link arm 84 is free to rotate about the longitudinal centerline of clevis pin 98. In an alternative embodiment, individual hydraulic cylinders are simply mounted on end block 64 rather than being formed integrally therein.

Piston 78 and piston rod 80 are extended by introducing hydraulic fluid into bore 86 through rear port 100. Hydraulic fluid in front of piston 78 is vented through forward port 102. When the piston is fully extended, as shown in FIG. 6, movable gripper block 72 is moved to the forward end of slot 74. In this position the movable gripper blocks do not block the U-shaped opening and the replacement tool can be fitted over guidepost 18.

Piston 78 and piston rod 80 are retracted by introducing hydraulic fluid into bore 86 through forward port 102. Hydraulic fluid behind piston 78 is vented through rear port 100. This causes movable gripper block 72 to move backwardly and inwardly in slots 74 until it contacts guidepost 18. When both movable gripper blocks have been moved into this position, the guidepost 18 is firmly locked into replacement tool 60 by three point contact. By increasing the hydraulic fluid pressure the gripping pressure of the three gripper blocks can be increased. The surface of movable gripper blocks 72 and fixed gripper block 70 may be serrated so as to improve their gripping ability. Alternatively, replaceable teeth may be mounted in the three gripper blocks to improve gripping. The gripping pressure of the three gripper blocks must be high enough so that sufficient force can be transmitted to guidepost 18 to shear lock pins 36 without slippage of replacement tool 60. The necessary force may vary greatly depending on the total cross sectional shear area of the lock pins and the material used to manufacture the lock pins.

Figure 7:
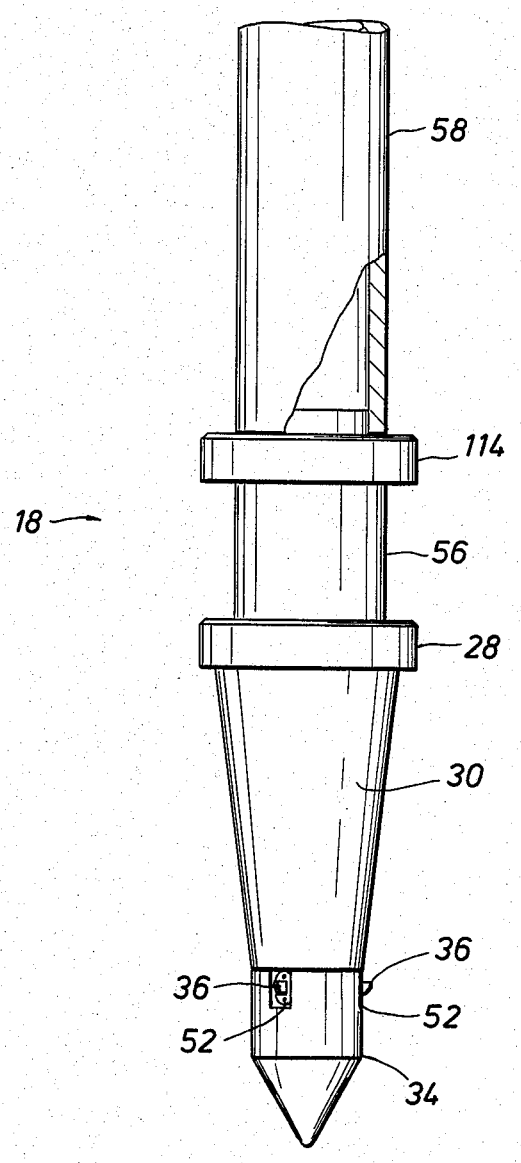
FIG. 7 is a side elevation of an alternate embodiment of the guidepost showing the use of a second shoulder to engage the replacement tool.

In an alternate embodiment, see FIG. 7, a second shoulder 114 is added at the top of lower section 56 of guidepost 18. The distance between support shoulder 28 and second shoulder 114 must be greater than the overall thickness of the replacement tool 60. Thus, even if replacement tool 60 slips along the outside of guidepost 18, it will contact the bottom surface of second shoulder 114 and thereby will transmit sufficient force to guidepost 18 to shear the lock pins.

In a preferred embodiment, replacement tool 60 is operated directly from the surface 20 of body of water 14. Referring again to FIG. 1, when a guidepost has been damaged the replacement tool 60 is lowered from drill ship 22 by cable 106 which is connected to eyes 104 (see FIG. 6) and fitted over the guidepost 18. A television camera 108 may be used to aid in properly positioning the replacement tool. Hydraulic lines 110 are used to activate the replacement tool's hydraulic cylinders. When the replacement tool is firmly attached to the damaged guidepost, winch 112 is used to apply the upward vertical force to shear the lock pins, as described above. The damaged guidepost is then removed and brought to the surface. An undamaged guidepost is then attached to the replacement tool and lowered by winch 112. The television camera 108 may be used to assist alignment of the replacement guidepost with the receptacle. As the guidepost is being inserted, the lock pins 36 contact tapered portion 32 (see FIG. 2). The weight of the guidepost causes the lock pins 36 to retract into cavities 48. When the guidepost is fully inserted, the lock pins extend and engage retaining groove 38 thereby locking the new guidepost in place. Alternatively, the replacement tool 60 and television camera 108 may be mounted to a subsea handling frame (not shown) which is capable of applying the upward vertical force.

The method and apparatus of the invention and the best mode contemplated for practicing the method have been described. It should be understood that the foregoing is illustrative only and that other means and obvious modifications can be employed without departing from the true scope of the invention defined in the following claims. For example, any replacement tool which is capable of gripping the guidepost and applying an upward vertical force thereto may be used. Also, other types of lock pin assemblies may be designed for use in connection with the invention.

What we claim is:

1. A remotely replaceable guidepost system for use in remote alignment of equipment being lowered from the surface of a body of water to a subsea structure located on the floor of said body of water, said remotely replaceable guidepost system comprising:

a receptacle formed integrally with or permanently rigidly attached to said subsea structure, said receptacle having an upper load-bearing surface;

a guidepost having a vertical axis, unobstructed upper section and a lower section, said lower section of said guidepost being remotely insertable into said receptacle;

a support shoulder formed integrally with or rigidly attached to said guidepost, said support shoulder being located between said upper section and said lower section of said guidepost such that said support shoulder contacts said upper load-bearing surface of said receptacle when said guidepost has been fully mated with said receptacle so that downward vertical loads on said guidepost are transmitted by said support shoulder to said receptacle; and means for releasibly locking said lower section of said guidepost into said receptacle, said locking means being releasible only by application of an upward vertical force to said guidepost.

2. The remotely replaceable guidepost system of claim 1 wherein said means for rdleasibly locking said lower section of said guidepost into said receptacle comprises:

a retaining groove formed in said receptacle;

at least one radially-oriented, spring loaded lock pin, said lock pin mounted in a bore in said lower section of said post and extending radially outwardly from said axis of said guidepost so as to engage said retaining groove and having a locking head shearable by said upward vertical force; and at least one helical compression spring mounted in said bore so as to urge said lock pin in a radially outwardly direction from said axis of said guidepost so that said lock pin engages said retaining groove when said guidepost has been fully mated with said receptacle.

3. The remotely replaceable guidepost system of claim 1 wherein said upper section of said guidepost has a lower section modulus than said lower section of said guidepost so as to control the location of potential damage to said guidepost.

4. The remotely replaceable guidepost system of claim 1 wherein said guidepost has a circular cross section.

5. The remotely replaceable guidepost system of claim 1 wherein said guidepost has a square cross section.

6. The remotely replaceable guidepost system of claim 1 wherein said lower section of said guidepost has a downwardly tapering portion below said support shoulder and said receptacle has a corresponding downwardly tapering segment, said tapering portion and said tapering segment cooperating to prevent binding between said guidepost and said receptacle during insertion or removal of said guidepost.

7. The remotely replaceable guidepost system of claim 6 wherein said downwardly tapering portion of said guidepost and said downwardly tapering segment of said receptacle have circular cross sections.

8. The remotely replaceable guidepost system of claim 6 wherein said downwardly tapering portion of said guidepost and said downwardly tapering segment of said receptacle have square cross sections.

9. A remotely replaceable guidepost system for use in connection with aligning equipment being lowered from an upper location to a structure located at a remote lower location, said remotely replaceable guidepost system comprising:

a receptacle formed integrally with or permanently rigidly attached to said structure, said receptacle having a retaining groove formed therein;

a guidepost having a vertical axis, an unobstructed upper end and a lower end, said lower end being remotely insertable into said receptacle;

at least one radially-oriented, spring loaded lock pin mounted in a bore in said lower end of said guidepost, said lock pin extending radially outwardly from said axis of said guidepost and having a locking head formed thereon for engaging said retaining groove, said locking head being shearable by application of an upward force;

at least one helical compression spring mounted in said bore to urge said lock pin in a radially outwardly direction from said axis of said guidepost; and remotely operable means for gripping said guidepost, and applying an upward force to said guide post sufficient to shear said lock pin so as to release said guidepost from said receptacle.

10. A method for remotely replacing a damaged guidepost on a subsea structure from a remote location at the surface of the body of water, said guidepost being attached to a receptacle on said subsea structure by one or more lock pins m:unted in said guidepost and oriented so as to engage a retaining groove formed in said receptacle, said method comprising the steps of:

applying an upward vertical force to said damaged guidepost from the surface of the body of water, said force being sufficient to shear said lock pins;

removing said damaged guidepost after said lock pins have been sheared; and inserting into said receptacle a new, undamaged guidepost having at least one radially-oriented, spring loaded lock pin mounted therein, said lock pin adapted to retract into said guidepost while said guidepost is being inserted into said receptacle and further adapted to extend and engage said retaining groove when said guidepost has been fully inserted into said receptacle.

11. The method of claim 10 wherein said upward vertical force is applied to said damaged guidepost by remotely operable gripping means operated from the surface of the body of water.

12. A method for remotely replacing a damaged guidepost on a subsea structure from a remote location at the surface of the body of water, said guidepost being attached to a receptacle on said subsea structure by one or more lock pins mounted in said guidepost and oriented so as to engage a retaining groove formed in said receptacle, said method comprising the steps of:

gripping said damaged guidepost with remotely operable gripping means operated from a vessel located at the surface of the body of water;

shearing said lock pins by applying an upward axial force to said damaged guidepost, said upward axial force being transmitted from said surface vessel to said damaged guidepost by said gripping means;

removing said damaged guidepost from said receptacle after said lock pins have been sheared; and inserting into said receptacle a new, undamaged guidepost having at least one radially-oriented, spring loaded lock pin mounted therein so that said lock pin engages said retaining groove.

* * * * *